US011154146B2

(12) United States Patent
Lamontagne et al.

(10) Patent No.: US 11,154,146 B2
(45) Date of Patent: Oct. 26, 2021

(54) PROTECTED DISPLAY STAND FOR WATCHES

(71) Applicant: The Swatch Group Research and Development Ltd, Marin (CH)

(72) Inventors: Alexandre Lamontagne, Cormondrèche (CH); Jonathan Bregnard, St-Aubin-Sauges (CH); Cedric Nicolas, Neuchâtel (CH)

(73) Assignee: The Swatch Group Research and Development Ltd, Marin (CH)

( * ) Notice: Subject to any disclaimer, the term of this patent is extended or adjusted under 35 U.S.C. 154(b) by 0 days.

(21) Appl. No.: 16/910,381

(22) Filed: Jun. 24, 2020

(65) Prior Publication Data

US 2021/0059436 A1 Mar. 4, 2021

(30) Foreign Application Priority Data

Aug. 26, 2019 (EP) ..... 19193625

(51) Int. Cl.

| | |
|---|---|
| ***A47F 7/024*** | (2006.01) |
| ***A47F 7/02*** | (2006.01) |
| ***G08B 13/12*** | (2006.01) |
| ***G08B 13/02*** | (2006.01) |

(52) U.S. Cl.

CPC ..... *A47F 7/024* (2013.01); *A47F 7/022* (2013.01); *G08B 13/02* (2013.01); *G08B 13/12* (2013.01)

(58) Field of Classification Search

CPC ..... A47F 7/024; A47F 7/022; G08B 13/02; G08B 13/12; G08B 13/14; G08B 13/1409; G08B 13/1418; G08B 13/1427; G08B 13/1445; G08B 13/1454; G08B 13/1472; G08B 13/149

USPC ..... 211/85.2; 340/568.2

See application file for complete search history.

(56) References Cited

U.S. PATENT DOCUMENTS

| | | | | | |
|---|---|---|---|---|---|
| 3,602,562 | A * | 8/1971 | Radelfinger | ..... | A47F 3/002 312/119 |
| 3,695,452 | A * | 10/1972 | Surman | ..... | A47F 7/024 211/4 |
| 4,057,958 | A * | 11/1977 | Wuntch | ..... | G04B 3/006 368/207 |
| 4,650,077 | A * | 3/1987 | Droz | ..... | A47F 7/022 206/480 |

(Continued)

FOREIGN PATENT DOCUMENTS

| | | | | |
|---|---|---|---|---|
| EP | 2810588 A1 * | 12/2014 | ..... | A47F 7/024 |
| JP | 55143063 U | 11/1980 | | |

(Continued)

OTHER PUBLICATIONS

European Search Report for EP 19 19 3625, dated Dec. 11, 2019.
Communication dated Jul. 13, 2021, from the Japanese Patent Office in application No. 2020-124978.

*Primary Examiner* — Jennifer E. Novosad
(74) *Attorney, Agent, or Firm* — Sughrue Mion, PLLC

(57) ABSTRACT

A display stand (1) for a watch, the display stand including an open or closed support loop (2), and configured to support a wristwatch when the strap is closed around the loop (2). The loop includes at least one electrical switch that can be actuated in one or other of two states, and wherein the state of the switch is determined according to the presence or absence of the watch around the loop (2), making it possible to manage the presence of the watch on the display stand.

5 Claims, 2 Drawing Sheets

(56) References Cited

U.S. PATENT DOCUMENTS 4,707,146 A * 11/1987 Wein ..... A47F 7/022 248/116
5,146,205 A * 9/1992 Keifer ..... A47F 7/024 340/540
5,579,906 A * 12/1996 Fabbri ..... A45C 11/12 206/1.5
5,810,165 A * 9/1998 Lai ..... A47F 7/022 206/18
5,873,457 A * 2/1999 Madweb ..... A45C 11/10 206/301
6,262,664 B1 * 7/2001 Maloney ..... G08B 21/0288 340/572.8
6,264,148 B1 * 7/2001 Chandler ..... A47F 7/022 206/301
6,629,677 B2 * 10/2003 Kirshner ..... A47F 7/022 206/301
6,831,560 B2 * 12/2004 Gresset ..... A47F 7/024 340/568.2
7,209,038 B1 * 4/2007 Deconinck ..... G08B 13/1409 340/541
7,239,238 B2 * 7/2007 Tester ..... G06K 19/07798 292/307 R
7,287,652 B2 * 10/2007 Scholen ..... A47F 5/0846 211/26
7,342,495 B2 * 3/2008 Sayegh ..... E05B 73/0017 24/704.1
8,523,122 B2 * 9/2013 Johnson ..... A47F 7/024 248/161
8,584,845 B2 * 11/2013 Soltis, Jr. ..... A47F 7/022 206/301
8,814,128 B2 * 8/2014 Trinh ..... F16M 11/041 248/551
9,353,552 B1 * 5/2016 Kelsch ..... A47F 5/00
D789,123 S * 6/2017 Akana ..... D6/682.5
D811,783 S * 3/2018 Janssens ..... D6/682.5
D826,604 S * 8/2018 De Iuliis ..... D6/682
D838,524 S * 1/2019 Akana ..... D6/682
10,304,299 B1 * 5/2019 Acosta ..... G08B 13/19
D856,046 S * 8/2019 Akana ..... D6/682
D876,132 S * 2/2020 Akana ..... D6/682
2004/0060879 A1 * 4/2004 Cohen ..... A47F 7/022 211/85.2
2006/0139170 A1 * 6/2006 Ott ..... G08B 13/149 340/568.2
2007/0171061 A1 * 7/2007 Belden ..... G08B 13/1463 340/568.2
2008/0142665 A1 * 6/2008 Belden ..... G08B 13/149 248/417
2009/0079566 A1 * 3/2009 Goldstein ..... G08B 13/1463 340/568.1
2013/0161054 A1 * 6/2013 Allison ..... G08B 13/1409 174/69
2013/0168527 A1 * 7/2013 Wheeler ..... A47F 7/024 248/542
2013/0241731 A1 * 9/2013 Fawcett ..... H02G 15/007 340/568.2
2014/0059828 A1 * 3/2014 Reynolds ..... F16M 13/00 29/428
2014/0060218 A1 * 3/2014 Bisesti ..... F16M 11/041 73/865.8
2014/0062698 A1 * 3/2014 Fawcett ..... A47F 5/0861 340/568.3
2014/0063238 A1 * 3/2014 Abdollahzadeh ..... A47F 7/024 348/143
2014/0118930 A1 * 5/2014 Sedon ..... G06F 1/1632 361/679.56
2016/0100041 A1 * 4/2016 Kim ..... H02G 3/185 455/557
2016/0235217 A1 * 8/2016 Johnston ..... A47F 3/002
2016/0307416 A1 * 10/2016 Marszalek ..... G08B 21/0247
2017/0046931 A1 * 2/2017 Hartweg ..... A47F 7/024
2017/0245663 A1 * 8/2017 Berglund ..... E05B 73/00
2018/0153317 A1 * 6/2018 Haroush ..... A47F 7/024
2019/0279476 A1 * 9/2019 Phillips ..... G08B 13/1409
2019/0392690 A1 * 12/2019 Helman ..... A47F 5/00
2021/0059436 A1 * 3/2021 Lamontagne ..... G08B 13/12

FOREIGN PATENT DOCUMENTS

JP 2007122563 A 5/2007
WO 01/97661 A1 12/2001
WO 02/39856 A1 5/2002
WO 2008/122829 A1 10/2008
WO WO-2008122829 A1 * 10/2008 ..... A47F 7/022
WO 2016/170524 A1 10/2016
WO WO-2018020521 A1 * 2/2018 ..... G08B 13/1409

* cited by examiner

PROTECTED DISPLAY STAND FOR WATCHES

CROSS REFERENCE TO RELATED APPLICATIONS

This application claims priority to European Patent Application No. 19193625.1 filed Aug. 26, 2019, the entire contents of which are incorporated herein by reference.

TECHNICAL FIELD OF THE INVENTION

The present invention relates to security systems applicable in luxury-watch shops.

PRIOR ART

In order to protect the products displayed in a shop, anti-theft systems of the wire type are well-known, which prevent a product installed on a display stand being taken away from said display stand. The systems of this type use a wire between the product and the display stand. These systems are also capable of managing the presence of products on the display stands and in the window. However, these systems are bulky and unaesthetic and require the installation of a cabled electrical or mechanical infrastructure.

SUMMARY OF THE INVENTION

The present invention aims to provide a display stand for watches that overcomes the drawbacks identified above. This aim is achieved by the subject of the attached claims. The invention relates to a protected display stand for a watch, the display stand comprising an open or closed support loop, and configured to support a wristwatch when the strap is closed around the loop, wherein the loop comprises at least one electrical switch that can be actuated in one or other of two states, and wherein the state of the switch is determined according to the presence or absence of the watch around the loop, making it possible to manage the presence of the watch on the display stand.

The display stand according to the invention makes it possible to protect a watch without the watch being connected to the display stand by a wire connection. The presence of a watch on the display stand can be monitored remotely, by managing the signal emitted by a detection apparatus connected to the switch.

Other features and advantages of the present invention will emerge in the following description of preferred embodiments, presented by way of non-limitative example with reference to the accompanying drawings.

DETAILED DESCRIPTION OF THE INVENTION

Figure 1:
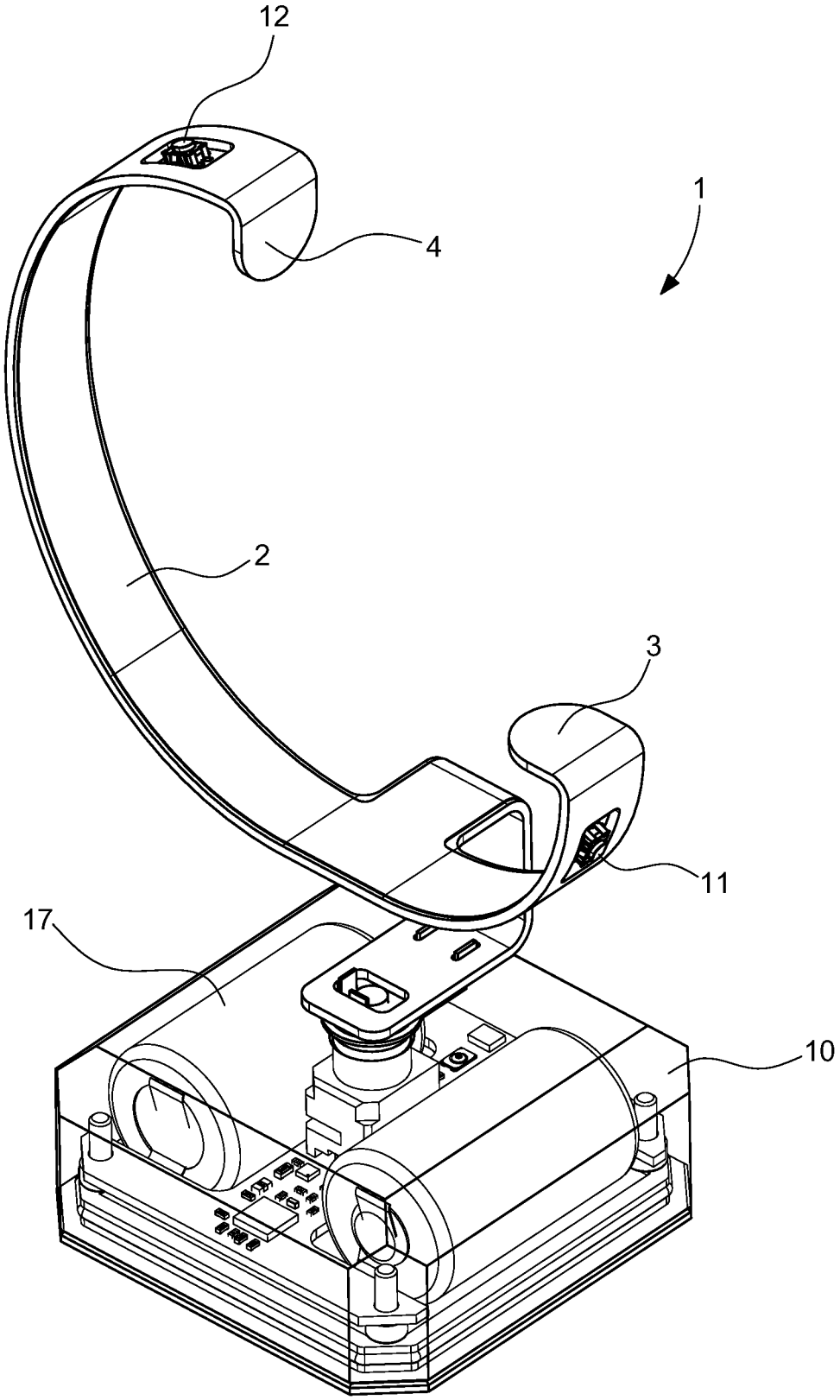
FIG. 1 depicts a 3D view of a display stand according to a preferred embodiment of the invention.
Figure 2:
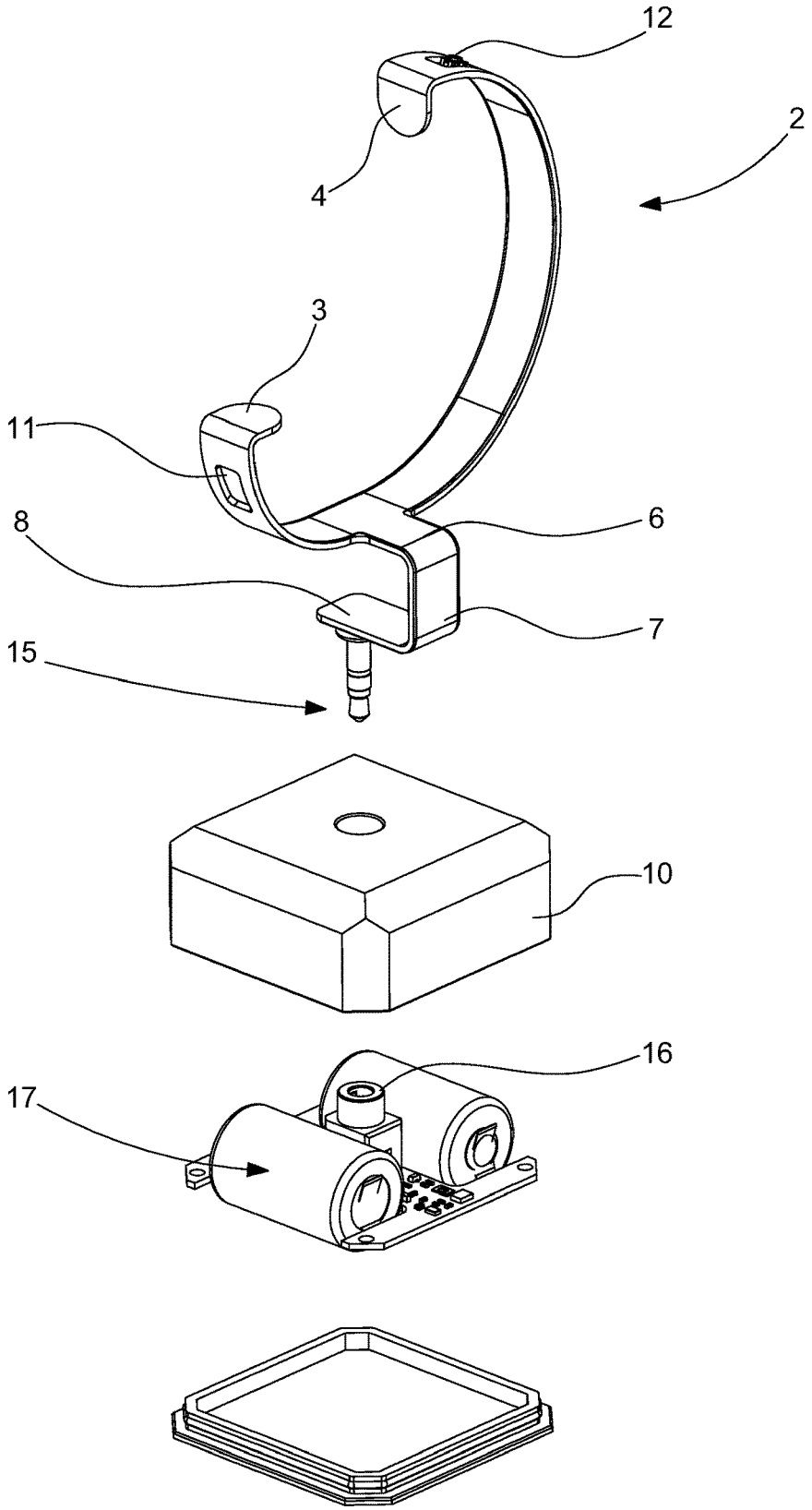
FIG. 2 depicts an exploded view of the display stand in FIG. 1.

According to a preferred embodiment of the invention, depicted in FIGS. 1 and 2, the display stand 1 comprises an open loop 2 formed by a flat band made from a rigid synthetic material such as a moulded polymer. The loop 2 extends between two ends 3 and 4, over approximately three quadrants of an angle of 360°, on an oval path, inclined towards the rear and corresponding essentially to the circumference of a human wrist, so that a wristwatch can be closed around the loop 2. The two ends 3 and 4 are folded towards the inside of the loop 2.

In the embodiment illustrated in the Figures, the loop 2 is integral with a support part, which emerges from the plane of the loop 2 at the lowest position of the loop, and which is in the form of three sides 6, 7 and 8 of a rectangle, leaving open a space that allows passage of the strap of a watch. The bottom side 8 of the rectangle is supported by a pedestal 10, which thus supports the loop 2.

A wristwatch can be mounted on the loop 2 by positioning the watch case approximately at the middle of the space between the two ends 3 and 4, so that the bottom surface of the lengths of the strap is in contact with the top surface of the loop 2, when the strap is closed around the loop by its closure system.

Close to the respective ends 3 and 4, two push button actuated switches 11 and 12 are integrated in the loop 2. The buttons emerge from the top surface of the loop 2. The buttons are pressed in by the bottom surfaces of the strap lengths, when the watch is tightened around the loop 2 with a normal force applicable for putting the watch around the wrist. The push button electrical switches 11 and 12 are integrated in the loop 2. The switches can be actuated in one or other of two states, referred to as "connected" and "disconnected". The switches are configured so that pressing in the buttons by said normal force puts the respective switches in one of the two states. Next, removing the normal force, i.e. removing a watch from the display stand, changes the state of the switches. For this purpose, the push button switches 11 and 12 are provided with springs or equivalent mechanisms configured so that the buttons are released automatically when the watch is removed from the display stand. Electrical conductors (not shown) are integrated in the loop 2 and in the support part 6, 7 and 8, and these conductors connect the switches to a detection apparatus.

This apparatus is situated inside the pedestal 10 on which the loop 2 is mounted. In the embodiment depicted in the Figures, the electrical conductors integrated in the loop 2 and in the support part 6, 7 and 8 are connected to a connector 15 of the mini jack plug type, which can be plugged into a socket 16 provided in the detection apparatus. This makes it possible to separate the loop 2 from the pedestal 10 and to reconnect it. According to an alternative, the conductors integrated in the loop 2 are connected to the detection apparatus by a non-detachable connection.

The detection apparatus can take any form known in the prior art, such as an electronic circuit and one or more batteries 17 that supply the circuit, the circuit being connected to the socket 16 to which the mini jack plug 15 can be connected. The detection apparatus is configured to detect the state of the switches and to generate a signal that is related to the state detected. In addition, the apparatus is configured to transmit this signal to an alert system outside the apparatus, and connected thereto by a wire or wireless connection.

The circuit, that connects the switches to the detection apparatus, can be implemented in several ways. For example, the two switches may be coupled in series, forming part of a simple circuit supplied by the battery of the detection apparatus, so that the disconnection of at least one switch, i.e. the release of at least one push button switch 11 or 12, cuts the supply or generates an interruption. This interruption will be detected by the detection apparatus, which transmits a signal representing the state of the switches in the event of interruption of the supply. The alert system receives this signal and can trigger an alert. Other more complex configurations can be envisaged by a person skilled in the art without departing from the scope of the accompanying claims.

The embodiment depicted in the Figures, which is provided with the detachable connection between the loop 2 and the pedestal 10 is preferably configured so that the disconnection of said connection, i.e. the removal of the mini jack plug 15, is detected by the detection apparatus and transmitted in the form of a specific signal that is recognisable to the alert system.

Other technical variants come within the scope of the claims. The loop 2 may be provided with a single push button switch instead of two, or more than two push button switches could be provided. Other devices may also be envisaged as alternatives to the push buttons switches (optical sensors, etc.). The loop 2 could be a closed loop instead of open. The open loop 2 as described above and depicted in the Figures may be fabricated from a rigid material, but one that allows elastic deformation of the loop itself when the ends 3 and 4 are brought closer to each other. This makes it possible to increase the contact force between the loop 2 and the strap lengths of a watch clamped on the loop, thus increasing the compression force of the push button switches 11 and 12.

The alert system may comprise a device receiving the signal related to the states of the switches and transmitted by the detection apparatus, such as a computer connected to the display stand by a wire or wireless connection.

According to one embodiment, the detection apparatus inside the pedestal comprises a local-transmission chip, such as a BLE (Bluetooth Low Energy) chip, which is capable of sending a signal that can be received by one or more receiving devices, such as smartphones or tablets situated within a defined area, that is customizable and defined around the chip. BLE technology allows the sending from the chip of a sequence of data referred to as an advertising frame continuously. The consecutive frames can be encoded by means of an identifier, that identifies the product protected by a code and which corresponds to the state of the buttons, and therefore of the switches. The continuous sending of these advertising frames enables the persons responsible to continuously manage the presence of a plurality of watches on a number of display stands. When a watch is removed by an unauthorised person, this change will immediately be represented in the advertising frames and signalled on the smartphones or tablets in the form of an audible alert signal for example. The smartphones are provided with a digital application, that manages the communication with the display stands and will indicate to the user an identifier of the watch, that has been removed, so that the user can then check the display stand in question.

What is claimed is:

1. A display stand, the display stand comprising an open support loop, and configured to support a wristwatch, when a strap of the wristwatch is closed around the support loop such that the wristwatch is present around the support loop, the support loop comprising electrical switches respectively including push buttons, integrated in the support loop, that can be actuated in one or other of two states, and wherein a state of the switch is determined according to whether the wristwatch is present around the support loop, to monitor the presence of the wristwatch on the display stand, the push buttons being configured so as to be pressed in by a pressure exerted by the wristwatch, when the wristwatch is present around the support loop, and released automatically, when the wristwatch is removed from the support loop, wherein the open support loop is formed by a flat band made from a rigid material, an angular space being formed between ends of the support loop, and wherein the push buttons are positioned proximate the ends, respectively.

2. The display stand according to claim 1, wherein the support loop is configured to be compressed elastically by bringing the ends closer to each other.

3. The display stand according to claim 1, further comprising a pedestal on which the support loop is mounted, and wherein the pedestal comprises a detection apparatus connected by an electrical circuit to said switches, and configured to detect the state of the switches and to generate and transmit respective signals related to the state detected.

4. The display stand according to claim 3, wherein the support loop is configured to be disconnected from the pedestal and reconnected to the pedestal by a plug-in electrical connection.

5. The display stand according to claim 3, wherein the detection apparatus comprises an electronic chip configured to transmit a signal, receivable only in a local area, that is customizable and defined around the electronic chip.

* * * * *